US007579568B2

(12) United States Patent
Nakade

(10) Patent No.: US 7,579,568 B2
(45) Date of Patent: Aug. 25, 2009

(54) SWITCH FOR VEHICLE

(75) Inventor: Yoshiyuki Nakade, Fukui (JP)

(73) Assignee: Panasonic Corporation, Osaka (JP)

( * ) Notice: Subject to any disclaimer, the term of this patent is extended or adjusted under 35 U.S.C. 154(b) by 113 days.

(21) Appl. No.: 11/869,982

(22) Filed: Oct. 10, 2007

(65) Prior Publication Data

US 2008/0110734 A1 May 15, 2008

(30) Foreign Application Priority Data

Nov. 14, 2006 (JP) ..... 2006-307439

(51) Int. Cl.
*H01H 13/12* (2006.01)

(52) U.S. Cl. ..... 200/531; 200/341

(58) Field of Classification Search ..... 200/520, 200/530–531, 341, 16 R, 16 A–16 D, 51.16
See application file for complete search history.

(56) References Cited

U.S. PATENT DOCUMENTS 5,008,505 A * 4/1991 Takano et al. ..... 200/531
5,063,277 A * 11/1991 Takano et al. ..... 200/531
5,382,767 A * 1/1995 Takano et al. ..... 200/531
5,727,675 A * 3/1998 Leveque et al. ..... 200/524
5,803,242 A * 9/1998 Takano et al. ..... 200/530
5,828,024 A * 10/1998 Takano et al. ..... 200/531
5,836,442 A * 11/1998 Hirano ..... 200/284
7,485,825 B2 * 2/2009 Nishikawa et al. ..... 200/520

FOREIGN PATENT DOCUMENTS

JP 2006-147552 6/2006

* cited by examiner

*Primary Examiner*—Michael A Friedhofer
*Assistant Examiner*—Lisa N Klaus
(74) *Attorney, Agent, or Firm*—RatnerPrestia

(57) ABSTRACT

In the switch, a terminal section and a contact section of a fixed contact are separately formed and the two sections are connected via a coil made of a conductive metal wire. After electrical connection is established between a movable contact and fixed contacts, a weak current with no arc discharge flows between the movable and the fixed contacts. This prevents build-up of oxide or carbide on the contact surface, allowing the switch to have stable contact operation and accordingly reliable electrical connection.

4 Claims, 12 Drawing Sheets

SWITCH FOR VEHICLE

FIELD OF THE INVENTION

The present invention relates to a switch for a vehicle that effects on/off-control of a brake light in brake-pedal operations.

BACKGROUND ART

In recent years, vehicles have widely employed depress-type switches for turning on/off the brake light in brake-pedal operations. In this type of switch, the brake light turns on when depressing force is exerted on the brake pedal and the light turns off when the force is removed.

Such a conventional switch will be described hereinafter with reference to FIG. 12.

FIG. 12 is a section view of a conventional switch for a vehicle. The switch, as shown in the drawing, has case 1 with substantially a top-open box shape and actuating unit 2, both of which are made of insulating resin. Case 1 has a plurality of fixed contacts 3. Terminal sections 3A of fixed contacts 3 extend out from the bottom of case 1.

Spring 5 is placed, under a slight compression, between the bottom of case 1 and conductive metal-made movable contact 4. The resilient force of spring 5 pushes movable contact 4 upward so that movable contact 4 makes contact with fixed contacts 3. In this way, fixed contacts 3 are electrically connected via movable contact 4.

Coil-shaped returning spring 6 is disposed, under a slight compression, between the lower section of actuating unit 2 and the bottom of case 1 so as to urge actuating unit 2 upward.

Cover 7, which covers the top opening of case 1, has hollow cylinder 7A that extends upward. Operation shaft 2A of actuating unit 2 is inserted in hollow cylinder 7A so as to have vertical movement. The top end of operation shaft 2A protrudes beyond the top end of hollow cylinder 7A. The conventional switch for a vehicle is thus completed.

Such structured conventional switch is usually disposed before the brake pedal, with operation shaft 2A of actuating unit 2 depressed by an arm or the like. At the same time, terminal section 3A of fixed contacts 3 is connected by a connector or the like to an LED of the brake light.

Under the condition where a driver does not step on the brake pedal, operation shaft 2A of actuating unit 2 in a depressed state keeps spring 5 and returning spring 6 in compression, allowing movable contact 4 to move away from fixed contacts 3. Fixed contacts 3 have no electrical connection therebetween and therefore the brake light turns off.

When a driver steps on the brake pedal, the arm moves away from operation shaft 2A and therefore no depressing force exerts on the springs. The spring-back force of returning spring 6 pushes actuating unit 2 upward; at the same time, spring 5 urges movable contact 4 upward, allowing contact 4 to make contact with fixed contacts 3. Fixed contacts 3 have electrical connection and therefore the brake light turns on.

In recent years, such a brake light is often formed of an LED and a voltage of 12 V DC and a current ranging from 0.5 A to 2A is fed to the LED. Each time the contact between movable contact 4 and fixed contacts 3 is made and broken, a weak arc discharge occurs. The arc discharge causes oxide and carbide on the contact surface.

Such an arc discharge, since caused by a relatively small voltage and current, does not have enough energy for remove the oxide and carbide on the contact surface. As the switching operations between the fixed contacts and movable contact are repeatedly carried out, the aforementioned unwanted substances easily accumulate on the surface.

In the prior art, for example, Japanese Patent Unexamined Publication No. 2006-147552 disclosed a conventional switch relating to the invention.

As described above, when such an LED switch for controlling an electric circuit that carries a relatively small voltage and current, oxide and carbide easily accumulates on the contact surface. This can cause a poor contact between movable contact 4 and fixed contacts 3.

SUMMARY OF THE INVENTION

The present invention addresses the problem above. It is therefore the object of the present invention to provide a switch for a vehicle capable of obtaining stable contact operation with a simple structure and reliable electrical connection.

To attain the object, the switch of the present invention has the following aspects.

As an aspect of the present invention, the switch has a structure where a terminal section and a contact section of a fixed contact are separately formed and the two sections are connected via a coil made of a conductive metal wire. A movable contact makes contact with the fixed contact by self-inductance of the coil, and after that, a weak current with no arc discharge is fed between the movable and fixed contacts. This suppresses the accumulation of oxide, carbide and other unwanted substances on the contact surface, providing reliable contact condition. Such structured switch offers reliable electrical switching operations.

As another aspect of the present invention, the switch has a structure where a rectifying diode is disposed in parallel with a coil between the terminal section and the contact section. For example, the cathode of the rectifying diode is connected on the positive side of the coil of the switch that is connected to battery, and the anode of the diode is connected on the negative side of the coil. Although the coil produces back-electromotive force in the switching operations between the movable contact and the fixed contacts, the back-electromotive force flows into the rectifying diode as current. Therefore, the contacts have no back-electromotive force therebetween. This protects the contact surface from damage.

As still another aspect of the present invention, the switch has a structure where the terminal section and the contact section that are separately formed and then secured as an integrated structure by an insulating resin-made holder. Compared to a structure having separate two sections, soldering work of the coil and the rectifying diode is easily carried out on the integrated structure. At the same time, the integrated structure enhances efficiency of manufacturing processes, for example, in attaching and securing it to the case.

The present invention, as described above, offers an improved switch for a vehicle capable of providing reliable electrical switching operation with a simple structure.

DETAILED DESCRIPTION OF THE INVENTION

The exemplary embodiments of the present invention are described hereinafter with reference to the accompanying drawings, FIG. 1 through FIG. 11.

First Exemplary Embodiment

Figure 1:
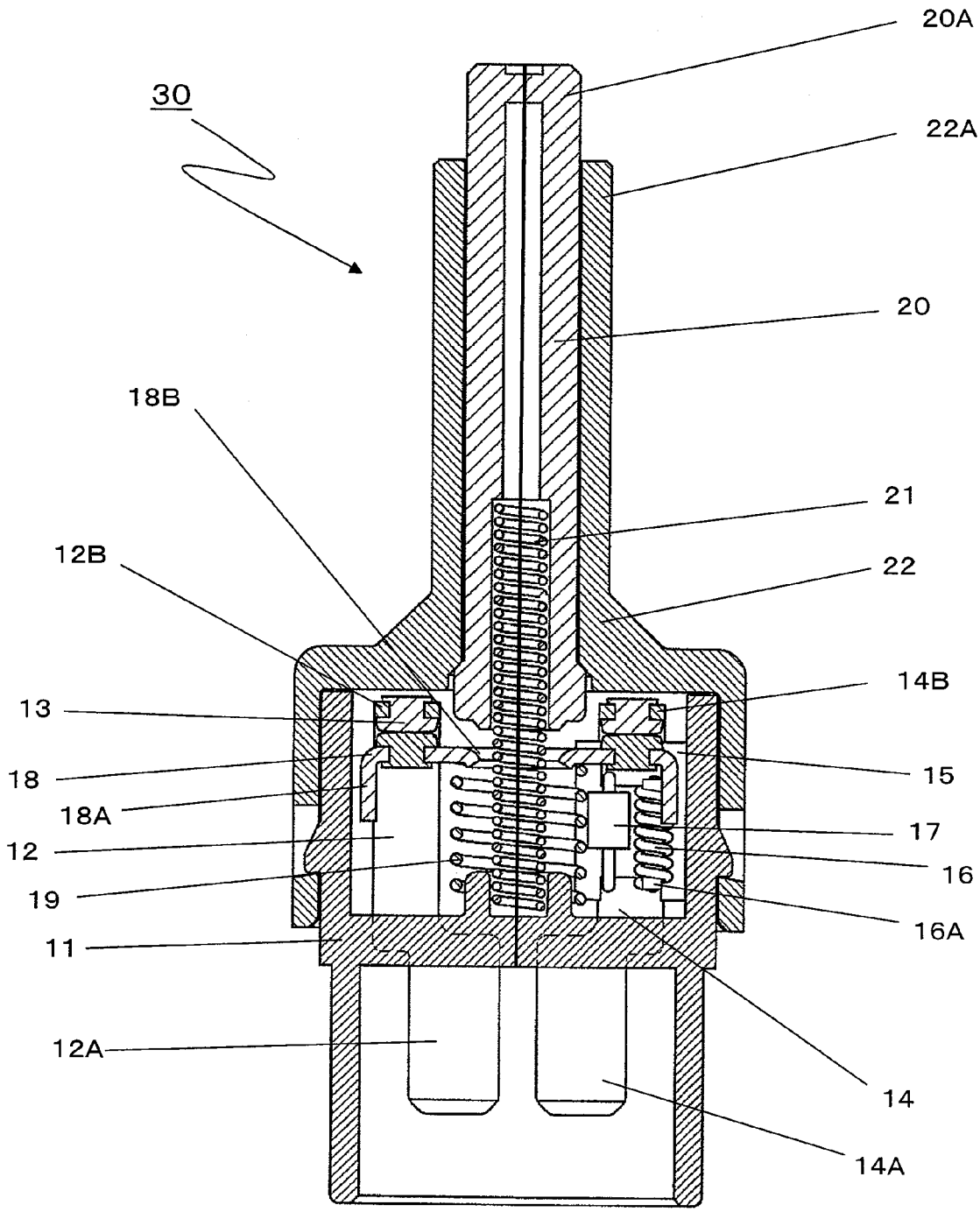
FIG. 1 is a section view of a switch for a vehicle in accordance with a first exemplary embodiment of the present invention.
Figure 2:
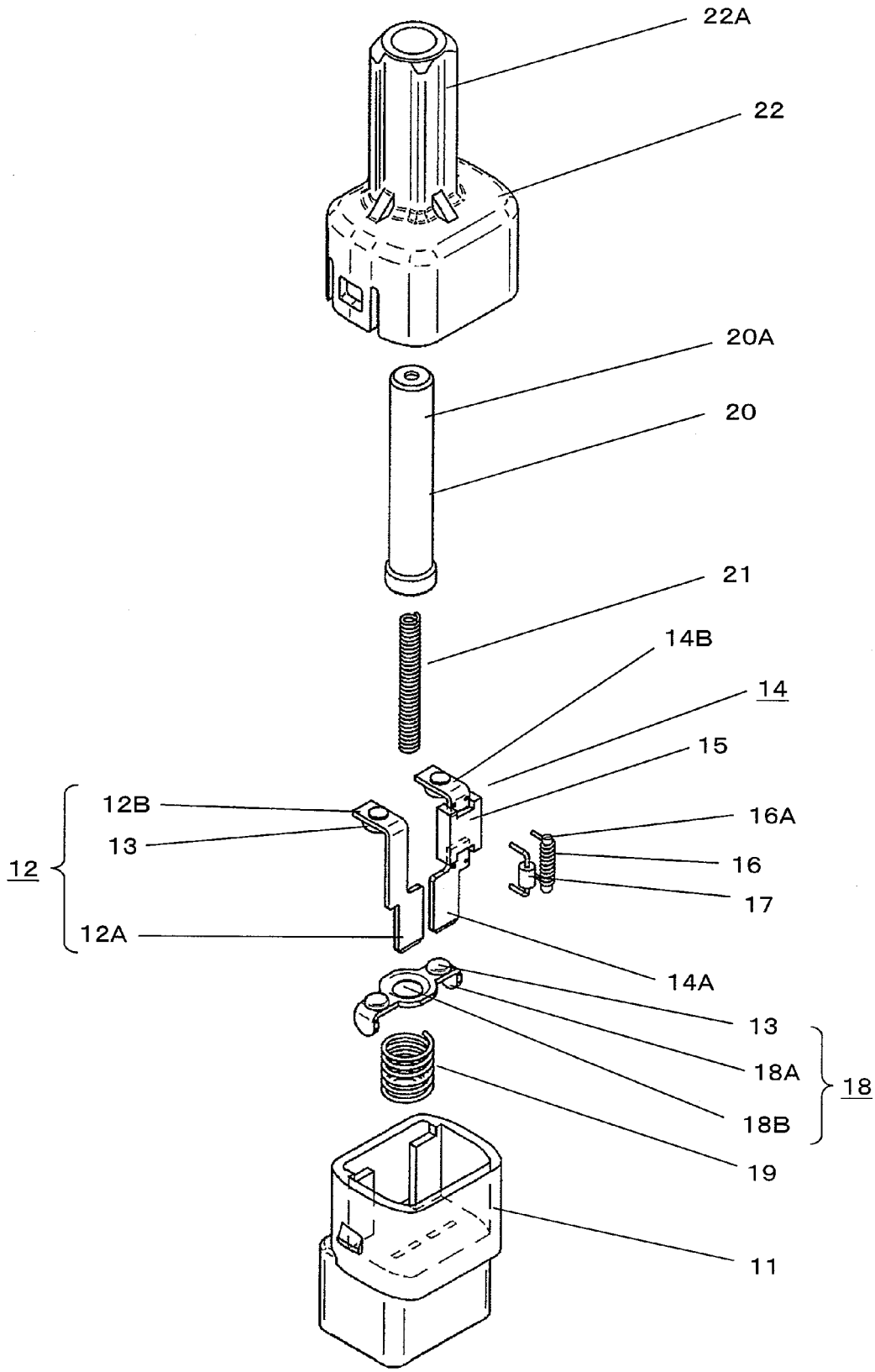
FIG. 2 is an exploded perspective view of the switch.
Figure 3:
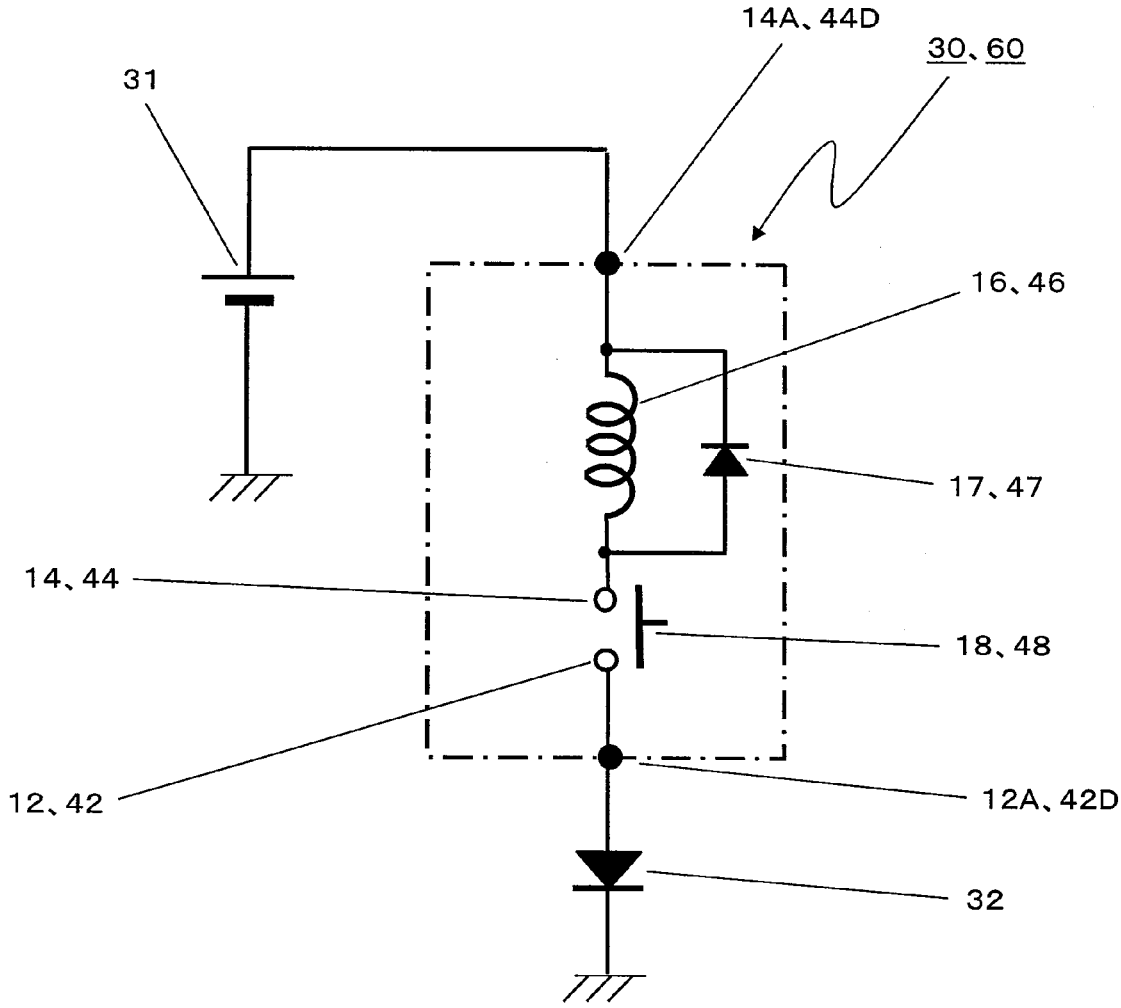
FIG. 3 is a circuit diagram showing the essential part of the switch.
Figure 4:
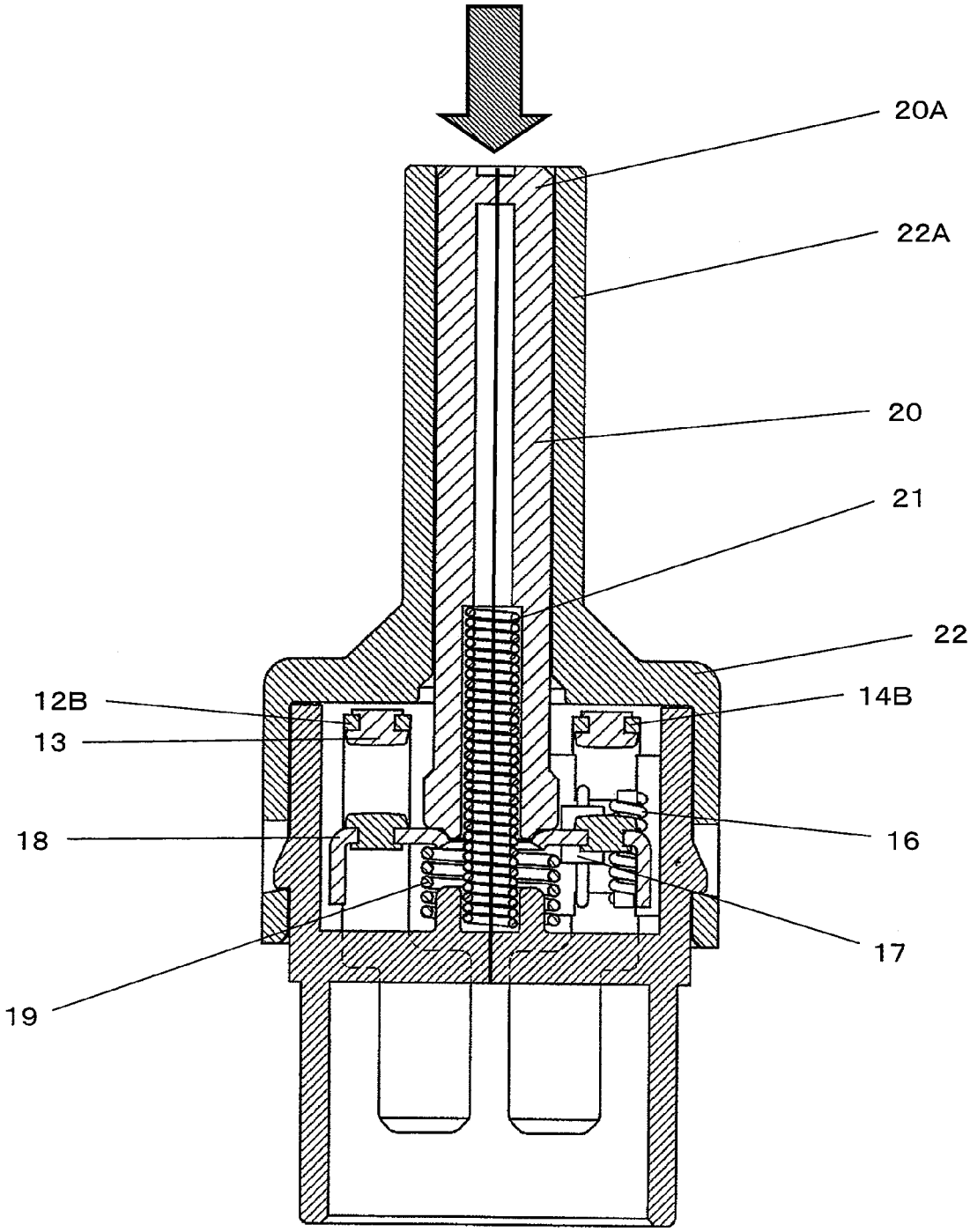
FIG. 4 is a section view of the switch in operation.

FIG. 1 is a section view of a switch for a vehicle in accordance with the first exemplary embodiment of the present invention. FIG. 2 is an exploded perspective view of the switch. FIG. 3 is a circuit diagram showing the essential part of the switch. Insulating resin-made case 11 is formed into substantially a top-open box shape. Terminal section 12A protrudes downwardly from the bottom of case 11. Fixed contact 12 is made of a conductive metal plate and is formed into substantially an inverted L shape. Fixed contact 12 has a bend at its upper end and rivet-like contact 13 is fixed to the bend. The bend and contact 13 form contact section 12B.

Fixed contact 14 has a structure similar to that of fixed contact 12; like fixed contact 12, fixed contact 14 is made of a conductive metal plate. Terminal section 14A of fixed contact 14 protrudes downwardly from the bottom of case 11. At the upper end of fixed contact 14, a bend and rivet-like contact 13 form contact section 14B. However, fixed contact 14 differs from fixed contact 12 in that terminal section 14A and contact section 14B are formed as a separate structure and they are located at an interval in the vertical direction.

Holder 15 secures contact section 14B in the upper position and terminal section 14A in the lower position. Holder 15 is made of heatproof insulating resin, such as glass-containing polybutylene terephthalate. Contact section 14B and terminal section 14A are fixed together as an integrated structure by insert molding, with the two sections kept in insulation.

The switch further contains coil 16 and rectifying diode 17. Coil 16 has a structure where a conductive-metal wire made of copper, copper alloy or the like is wound around iron core 16 that is made of ferrite as a ferromagnetic material. Coil 16 and rectifying diode 17 are disposed on fixed contact 14 in a way that each upper end of coil 16 and diode 17 and each lower end of them are inserted into each connecting section—may be a through-hole or a notch—formed in lower position of contact section 14B and in upper position of terminal section 14A, respectively, and then secured by soldering. Terminal section 14A and contact section 14B are connected via coil 16 and rectifying diode 17 disposed in parallel with the coil.

Movable plate 18A is made of conductive metal and is formed into a square-cornered U shape. Through-hole 18B is formed in the center of movable plate 18A. On the top of both ends of movable plate 18A, rivet-like contacts 13 are secured. Movable contact 18 is thus completed.

Spring 19, which is disposed under a slight compression between the bottom of case 11 and movable contact 18, urges movable contact 18 upward, by which contacts 13 disposed on the both ends of movable contact 18 make resilient contact with contacts 13 of fixed contacts 12 and 14 disposed in side-by-side arrangement. In this way, fixed contacts 13 and 14 have electrical connection via movable contact 18.

The switch further has actuating unit 20 with a substantially cylindrical shape, cover 22 and coil-shaped returning spring 21. Actuating unit 20 and cover 22 are made of insulating resin. Inserted into through-hole 18 of movable contact 18, returning spring 21 is disposed under a slight compression between the bottom of actuating unit 20 and the bottom of case 11 so as to urge actuating unit 20 upward.

Cover 22 has hollow cylinder 22A that protrudes upward. Operation shaft 20A of actuating unit 20 is inserted through hollow cylinder 22A so as to have vertical movement, with the top end of operation shaft 20A upwardly protruded beyond hollow cylinder 22A. Switch 30 for a vehicle is thus structured.

Such structured switch 30 is generally disposed before the brake pedal (not shown), with operation shaft 20A of actuating unit 20 depressed by an arm (also not shown) or the like.

Besides, as shown in a circuit diagram showing the essential part of the structure (FIG. 3), terminal section 14A of fixed contact 14 of switch 30 is connected on the positive side of power supply 31, such as a battery. Terminal section 12A of fixed contact 12 is connected, via a connector (not shown), to brake light 32 formed of at least one LED. At the same time, the cathode of rectifying diode 17 is connected on the positive side of coil 16, and the anode of the diode is connected on the negative side of coil 16.

Under the condition where a driver does not step on the brake pedal, as shown in a section view of the switch in operation (FIG. 4), operation shaft 20A of actuating unit 20 in a depressed state keeps spring 19 and returning spring 21 in compression, allowing movable contacts 18 to move away from contacts 13 of fixed contacts 12 and 14. Fixed contacts 12 and 14 have no electrical connection therebetween and therefore brake light 32 turns off.

When a driver steps on the brake pedal, the arm moves away from operation shaft 20A and therefore no depressing force exerts on the springs. As is shown in FIG. 1, the spring-back force of returning spring 21 pushes actuating unit 20 upward; at the same time, spring 19 urges movable contact 18 upward, allowing contact 18 to make contact with contacts 13 of fixed contacts 12 and 14. That is, fixed contacts 12 and 14 are electrically connected, by which electric power with a voltage of 12V DC and a current of 2 A is fed from battery 31 to brake light 32. As a result, brake light 32 turns on.

Figure 5:
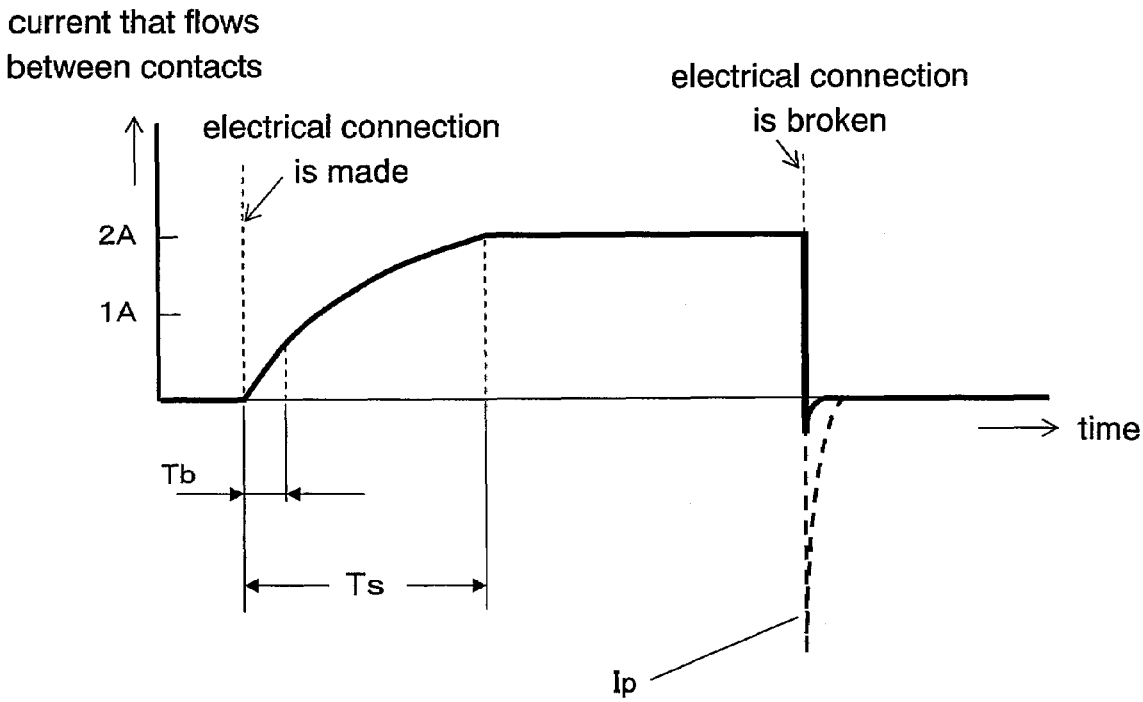
FIG. 5 shows a waveform of the current that flows in the switch.

When movable contact 18 makes resilient contact with fixed contacts 12 and 14, a current is fed to coil 16 connected between terminal section 14A and contact section 14B of fixed contact 14. FIG. 5 shows the waveform of the current that flows in movable contact 18 and fixed contacts 12 and 14. According to FIG. 5, after opposing contacts 13 make contact, the current gradually increases by self-inductance effect of coil 16 and reaches a steady state with a stable current-flow of approx. 2 A in time Ts.

When coil 16 with an inductance of 100 μH-500 μH and a resistance of 1Ω-3Ω is employed in the structure above, time Ts (the time that elapses before reaching the steady-state current of 2A) measures approx. 200 μs. That is, after movable contact 18 makes contact with fixed contacts 12 and 14, opposing contacts 13 carry a weak current with no arc discharge.

When spring 19 urges movable contact 18 to make resilient contact with fixed contacts 12 and 14, contacts 13 of each contact get in-contact and out-of-contact in quickly cycles, which is called contact bounce. The time where the contact bounce occurs, which is represented by time Tb in FIG. 5, lasts as short as 10 μs—50 μs and the current that flows between contacts 13 measures, at most, 0.5 A. Therefore, arc discharge unlikely occurs during in time Tb (where the contact bounce occurs).

During the period where the contact bounce is being observed since the electrical connection established between movable contact 18 and fixed contacts 12, 14, a weak current with no arc discharge flows between contacts 13 by self-inductance effect of coil 16 disposed between terminal section 14A and contact section 14B. Such a weak current suppresses build-up of oxide and carbide on the contact surface, maintaining the surface clean and therefore providing stable contact operation.

When a driver stops stepping on the brake pedal, actuating unit 20 is depressed downward, by which movable contact 18 moves away from fixed contacts 12 and 14. In the structure where coil 16 is disposed between terminal section 14A and contact section 14B, a large back-electromotive force with a shape of a steeple is produced by self-inductance of coil 16 in a direction opposite to the current flow. The back-electromotive force causes back-electromotive current Ip in the order of several dozen amperes between contacts 13 in an extremely short period (several microseconds), which produces arc discharge.

The embodiment of the present invention, however, has the structure shown in FIG. 1 and FIG. 3; rectifying diode 17 is connected in parallel to coil 16 between terminal section 14A and contact section 14B, with the cathode of the diode connected on the positive side of coil 16 and the anode connected on the negative side of coil 16. By virtue of the structure, the back-electromotive force produced by coil 16 is cancelled out as a current that flows into rectifying diode 17.

That is, when movable contact 18 makes contact with fixed contacts 12 and 14, current flows in the plus-to-minus direction; electric power is not fed to rectifying diode 17 because the rectifying direction is opposite to that of the current flow. Rectifying diode 17 can carry current via coil 16 only. On the other hand, when movable contact 18 moves away from the fixed contacts, the back-electromotive force of coil 16 is cancelled out by rectifying effect of rectifying diode 17 and flows into diode 17 as a forward current. Therefore, contacts 13 have no back-electromotive force therebetween, and accordingly, no back-electromotive current Ip, nor arc discharge. The fact protects the contact surface from damage.

In a case where an LED is employed for brake light 32 and the LED operates on a voltage of 12V DC and on a current of 2 A, as described above, the structure preferably should use coil 16 with an inductance of 100 μH—500 μH and a resistance of 1Ω—3Ω. However, the selection of coils is flexible according to the magnitude of voltage and current and other conditions. For example, a coil with no iron-core and relatively small inductance is suitable for the structure that operates on a current smaller than 2 A, and a coil with a large inductance is effective in suppressing contact bounce.

Besides, according to the structure of the embodiment, terminal section 14A and contact section 14B are separately formed and then secured as an integral structure by holder 15. Compared to a structure having separate two sections, soldering work of coil 16 and rectifying diode 17 is easily carried out on the integrated structure. At the same time, the integrated structure increases the efficiency of the assembling process of the switch. For example, fixed contact 14 as an integrated structure, with coil 16 and diode 17 have been soldered thereto, can be inserted in the top opening of case 11 and fixed to a right place with ease.

The switch of the embodiment, as described above, employs a structure where terminal section 14A and contact section 14B of fixed contact 14 are separately formed and the two sections are connected via coil 16 made of a conductive metal wire. With the structure above, when movable contact 18 makes contact with fixed contacts 12 and 14, a weak current with no arc discharge flows between contacts 13 by self-inductance effect of coil 16. Such a weak current suppresses build-up of oxide and carbide on the contact surface, providing switch 30 capable of maintaining the surface clean and therefore offering stable contact operation.

Besides, connecting rectifying diode 17 in parallel with coil 16 between terminal section 14A and contact section 14B brings the following advantage. That is, although coil 16 produces a back-electromotive force when movable contact 18 moves away from fixed contacts 12 and 14, the back-electromotive force is cancelled out as a current that flows into rectifying diode 17. Contacts 13 therefore undergo no back-electromotive force, by which damage on the contact surface is minimized.

Furthermore, according to the structure of the embodiment, terminal section 14A and contact section 14B are separately formed and then secured as an integral structure by holder 15. Compared to a structure having separate two sections, soldering work of coil 16 and rectifying diode 17 is easily carried out on the integrated structure. At the same time, the integrated structure increases the efficiency of the assembling process of the switch.

Although the description above introduces the structure where terminal section 14A and contact section 14B of fixed contact 14 are separately formed, it is not limited thereto. It will be understood that the same effect is provided by the structure where terminal section 12A and contact section 12B of fixed contact 12 are separately formed and rectifying diode 17 is connected in parallel with coil 16 between the two sections.

Second Exemplary Embodiment

The description in the second exemplary embodiment introduces an example in which the structure of a fixed contact and a movable contact differs from that described in the first exemplary embodiment.

Figure 6:
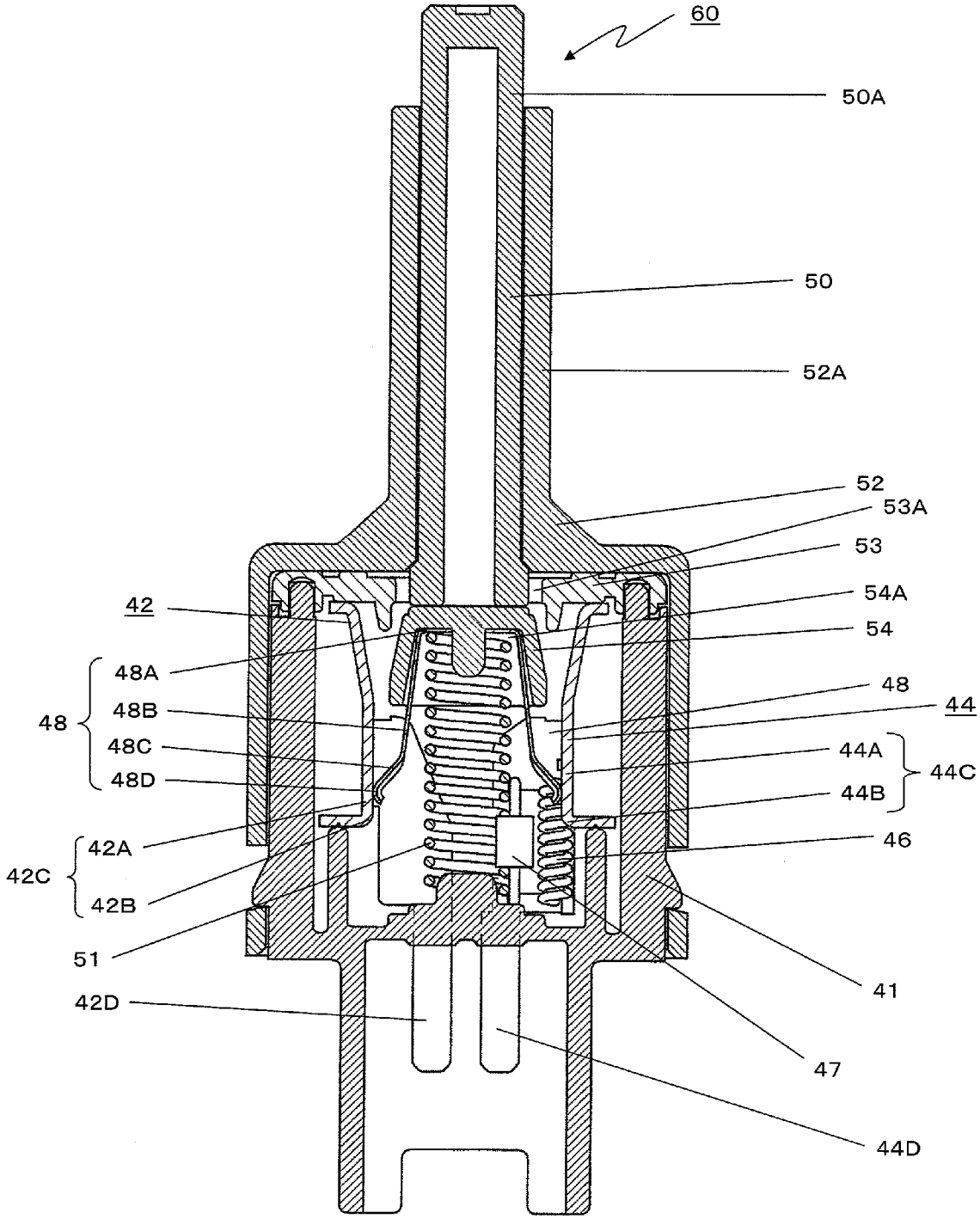
FIG. 6 is a section view of a switch for a vehicle in accordance with a second exemplary embodiment.
Figure 7:
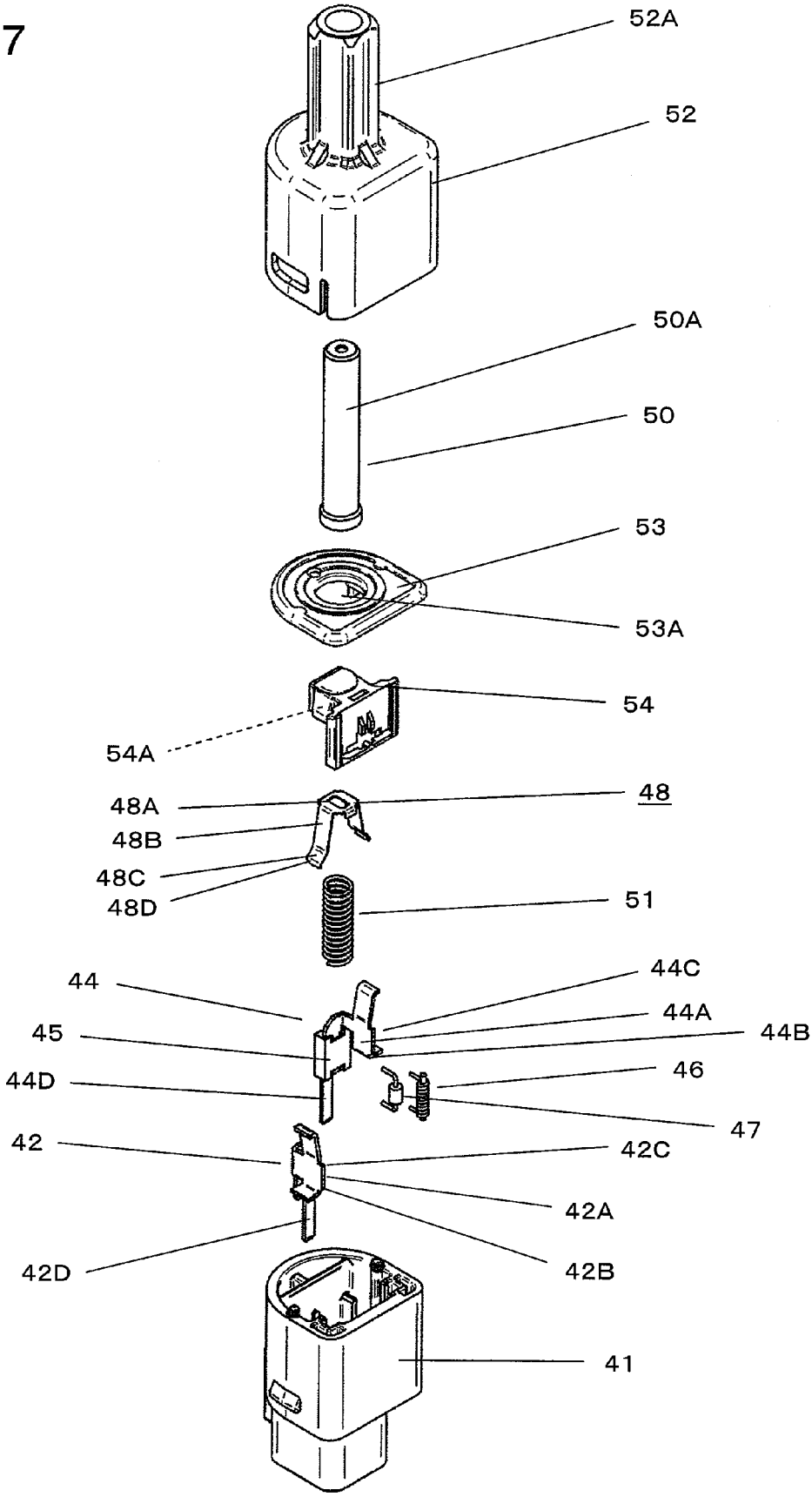
FIG. 7 is an exploded perspective view of the switch.
Figure 8:
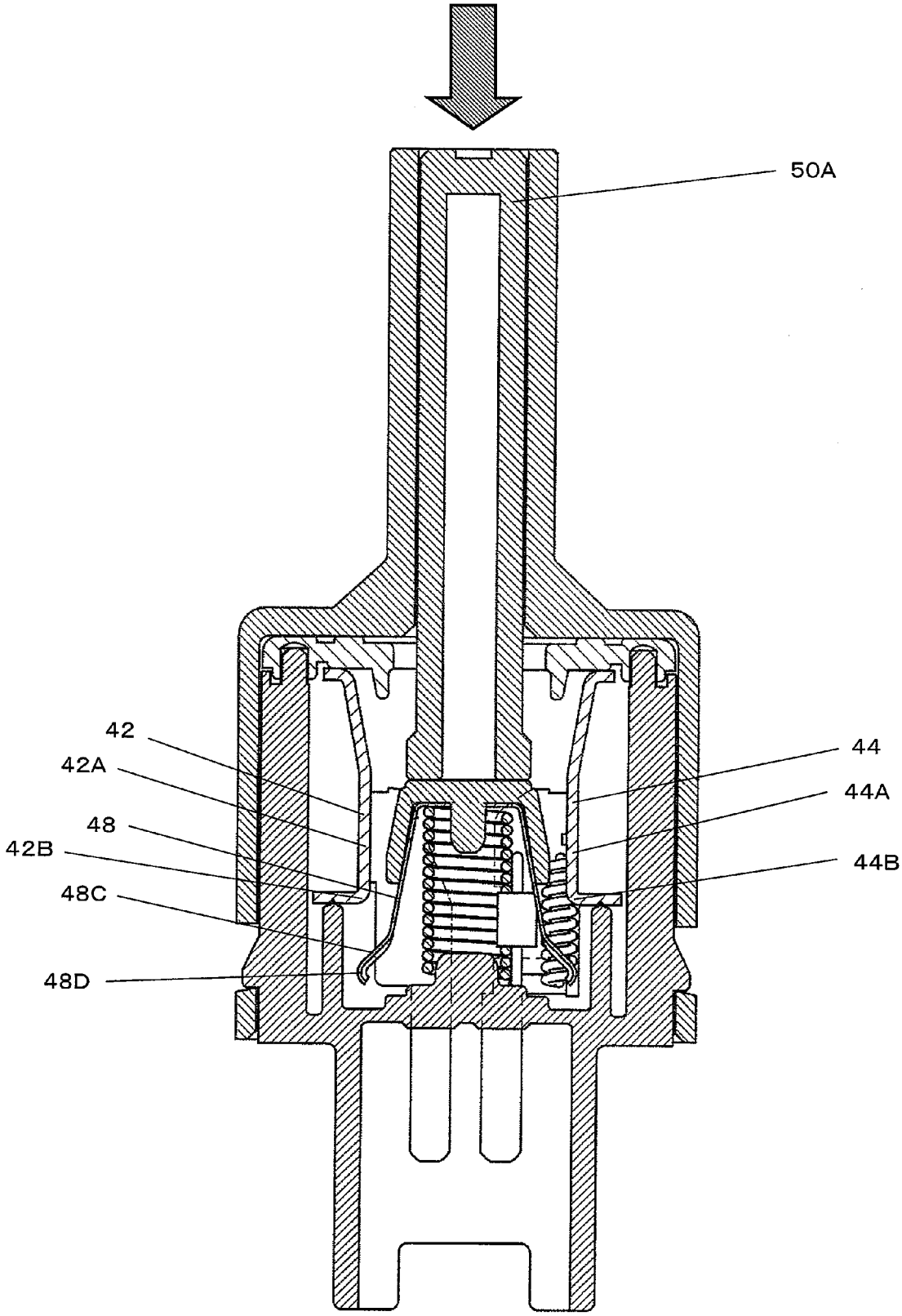
FIG. 8 is a section view of the switch in operation.

FIG. 6 is a section view of a switch for a vehicle in accordance with the second exemplary embodiment. FIG. 7 is an exploded perspective view of the switch. Fixed contact 42 is disposed in the left section (as is seen in FIG. 7) in insulating resin-made case 41 with a shape of a top-open box. Fixed contact 42, which is made of a conductive metal plate, has contact section 42C with a shape of a "mirrored" L. Contact section 42C has flat section 42A that extends upward and bend section 42B. In the lower section of fixed contact 42, terminal section 42D bends inward from the back side of contact section 42C and downwardly extends beyond the bottom of case 41.

Fixed contact 44, which is disposed in the right section (as is seen in FIG. 7) in case 41, has a structure similar to fixed contact 42. Fixed contact 44 has contact section 44C with an L shape. Contact section 44C has flat section 44A in the upper section and bend section 44B in the lower section. Like terminal section 42D, terminal section 44D downwardly extends beyond the bottom of case 41. However, fixed contact 44 differs from fixed contact 42 in that contact section 44C and terminal section 44D are formed as a separate structure and they are located at an interval in the vertical direction.

As for fixed contact 44, insulating resin-made holder 45 secures contact section 44C in the upper position and terminal section 44D in the lower position. Contact section 44C and terminal section 44D are fixed as an integrated structure by insert molding, with two sections kept in insulation. Flat section 42A of contact section 42C and flat section 44A of contact section 44C are oppositely disposed in an symmetrical arrangement.

The structure of the embodiment is similar to that of the first exemplary embodiment in the followings:

Coil 46 has a structure where a conductive-metal wire is wound around an iron core. Terminal section 44D and contact section 44C are connected with each other in a way that both ends of each of coil 46 and rectifying diode 47 are soldered to terminal section 44D and contact section 44C.

The top opening of case 41 is covered with cover 52 having hollow cylinder 52A. Actuating unit 50 with a substantially cylindrical shape is inserted through hollow cylinder 52A so as to have vertical movement.

The structure of the embodiment further contains spacer 53 and driving unit 54. Spacer 53 is made of insulating resin and has through-hole 53A in the center for passing actuating unit 50 therethrough. Driving unit 54 is made of insulating resin and is disposed at the lower end of actuating unit 50. Driving unit 54 is accommodated in case 41 so as to be movable with actuating unit 50 in the vertical direction.

The structure further contains movable contact 48, which is made of a conductive metal plate with elasticity and is formed into a square-cornered U shape. Mid-portion 48A of movable contact 48 is retained in storage section 54A of driving unit 54. From the both ends of mid-portion 48A, a pair of first arm 48B extends downward in a direction away from each other. Each extending end of first arm 48B is further bent outwardly and is formed into second arm 48C. Each of second arm 48C has a ladle-like inward bend on its each tip, which functions as contact 48D.

Each contact 48D makes resilient contact with flat sections 42A and 44A of fixed contacts 42 and 44, respectively, with first arm 48B and second arm 48C of movable contact 48 kept in a slight compression. In this way, fixed contacts 42 and 44 have electrical connection via movable contact 48.

Returning spring 51 is disposed under a slight compression between the bottom of case 41 and the bottom of storage section 54A of driving unit 54, by which driving unit 54 and actuating unit 50 are urged upward. Switch 60 for a vehicle is thus structured.

Such structured switch 60 is generally disposed before the brake pedal, with operation shaft 50A of actuating unit 50 depressed by an arm or the like. Besides, as shown in a circuit diagram showing the essential part of the structure of FIG. 3, terminal section 44D of switch 60 is connected on the positive side of power supply 31 and terminal section 42D of fixed contact 42 is connected to brake light 32. At the same time, the cathode of rectifying diode 47 is connected on the positive side of coil 46, and the anode of the diode is connected on the negative side of coil 46. the connection above is exactly the same as in the structure of the first exemplary embodiment.

That is, under the condition where a driver does not step on the brake pedal, as shown in a section view of the switch in operation (FIG. 8), operation shaft 50A in a depressed state allows movable contacts 48 to move away from fixed contacts 42 and 44. Fixed contacts 42 and 44 have no electrical connection therebetween and therefore brake light 32 turns off. When a driver steps on the brake pedal, the arm moves away from operation shaft 50A and therefore no depressing force exerts on the springs. As is shown in FIG. 6, the spring-back force of returning spring 51 pushes movable contact 48, actuating unit 50 and driving unit 54 upward. Through the movement, movable contact 48 makes resilient contact with fixed contacts 42 and 44, establishing electrical connection between fixed contacts 42 and 44. In this way, battery 31 feeds electric power with a voltage of 12V DC and a current of 2A to brake light 32, so that brake light 32 turns on.

In the connection process of the movable contact and fixed contacts, as a first step, each second-arm 48C of movable contact 48 makes contact with bends 42B and 44B of fixed contacts 42 and 44, respectively. After that, each second-arm 48C has resilient slide movement on bends 42B and 44B, bringing each contact 48D in resilient contact with flat sections 42A and 44A. Electrical connection between movable contact 48 and fixed contacts 42, 44 is thus established.

That is, in an early stage of the connection between movable contact 48 and fixed contacts 42, 44, each second-arm 48C of movable contact 48 has resilient slide movement on bends 42B and 44B, and finally, each contact 48D makes resilient contact with flat sections 42A and 44A. Movable contact 48 maintains the electrical connection with the use of different sections of contact 48. Compared to switch 30 described in the first exemplary embodiment where electrical connection is provided by oppositely disposed rivet-like contacts 13, the structure of the embodiment improves the stability of electrical connection between movable contact 48 and fixed contacts 42, 44 even if dust, gas or humidity gets into the switch and by which oxide or foreign matter is produced and accumulated on the contact surface of the fixed contacts.

When movable contact 48 makes resilient contact with fixed contacts 42 and 44, a current is fed to coil 46 connected between terminal section 44D and contact section 44C of fixed contact 44. FIG. 5 shows the waveform of the current that flows in movable contact 48 and fixed contacts 42 and 44. According to FIG. 5, after movable contact 48 makes contact with fixed contacts 42 and 44, the current gradually increases by self-inductance effect of coil 46 and reaches a steady state with a stable current-flow of approx. 2 A in a predetermined time. This decreases the tendency of arc discharge to occur between movable contact 48 and fixed contacts 42, 44 in the early stage of the connection. Besides, the switch of the embodiment has a structure that improves the stability of electrical connection, as described above, between movable contact 48 and fixed contacts 42, 44. These advantages allow the switch to enhance stable contact operation and accordingly providing reliable electrical connection.

When a driver stops stepping on the brake pedal, actuating unit 50 is depressed downward and by which movable contact 48 moves away from fixed contacts 42 and 44, back-electromotive force caused by coil 46 flows as a current into rectifying diode 47. Therefore, movable contact 48 and fixed contacts 42, 44 have no back-electromotive current, and accordingly, no arc discharge. This advantage is the same as is obtained in the structure of the first exemplary embodiment.

According to the structure of the embodiment, terminal section 44D and contact section 44C of fixed contact 44 are separately formed and connected via coil 46 made of a conductive metal wire. After electrical connection is established between movable contact 48 and fixed contacts 42, 44, a weak current with no arc discharge flows between the movable and the fixed contacts. This prevents build-up of oxide or carbide on the contact surface. Fixed contacts 42 and 44 are disposed in case 41 in a way that contact sections 42B and 44B, both of which are formed into an L shape, are oppositely located. Movable contact 48 is formed of mid-portion 48A, a pair of first arm 48B, a pair of second arm 48C and a pair of contact 48D. A pair of first arm 48B extends outwardly from the both ends of mid-portion 48A, and the extending each end of arm 48B is formed into second arm 48C. Contact 48D is formed on the tip of second arm 48C. Such structured movable contact 48 is accommodated in case 41 so as to be movable in the vertical direction. As actuating unit 50 moves in the vertical direction, movable contact 48 makes contact with fixed contacts 42, 44 and maintains the electrical connection with the use of different sections of contact 48.

Third Exemplary Embodiment

The description in the third exemplary embodiment introduces another example in which the structure of a fixed contact and a movable contact differs from that described in the first and the second exemplary embodiments.

In the description, like parts have similar reference marks as in the structures described in the previous two embodiments and detailed explanation thereof will be omitted.

Figure 9:
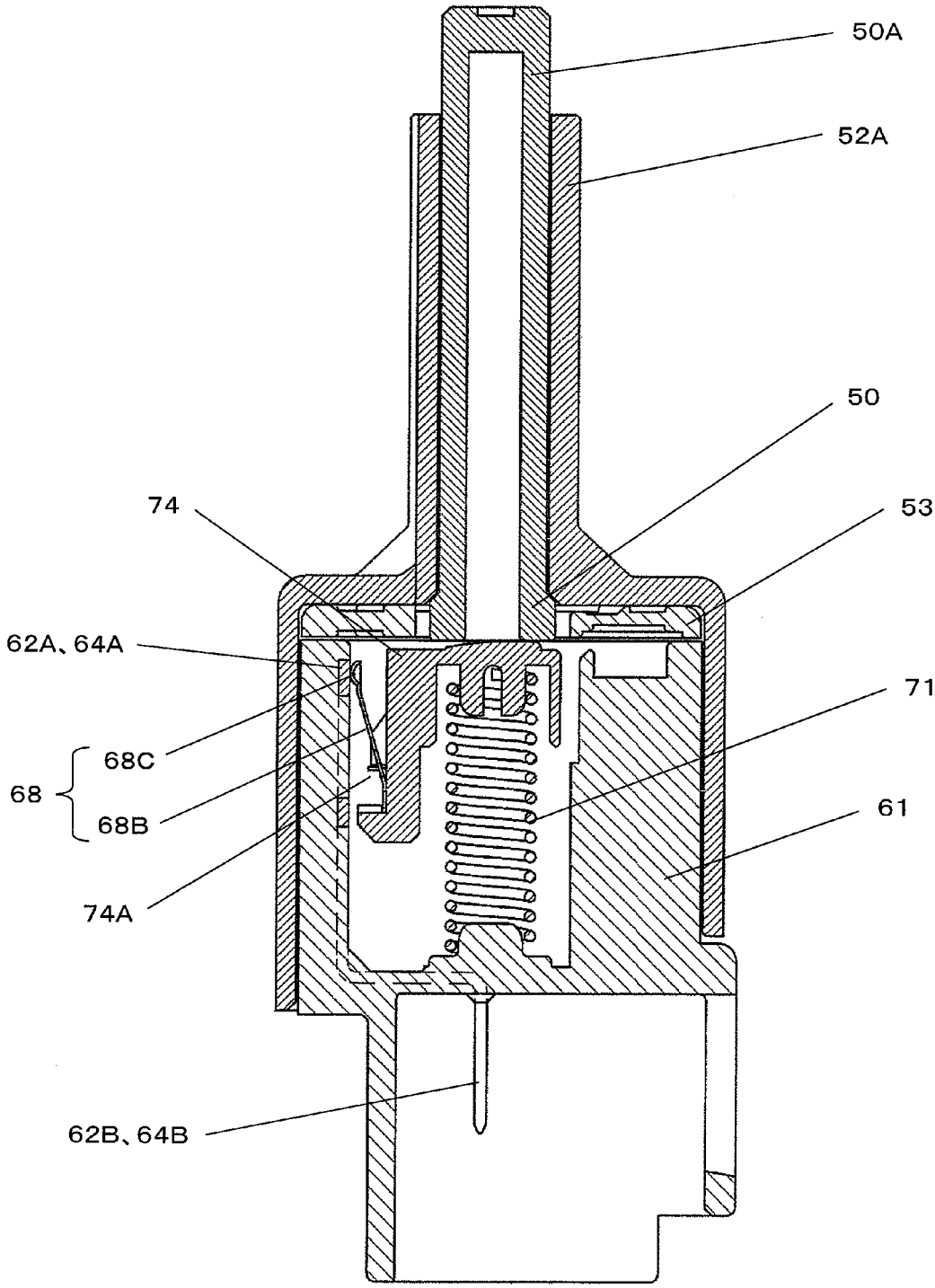
FIG. 9 is a side-section view of a switch for a vehicle in accordance with a third exemplary embodiment.
Figure 10:
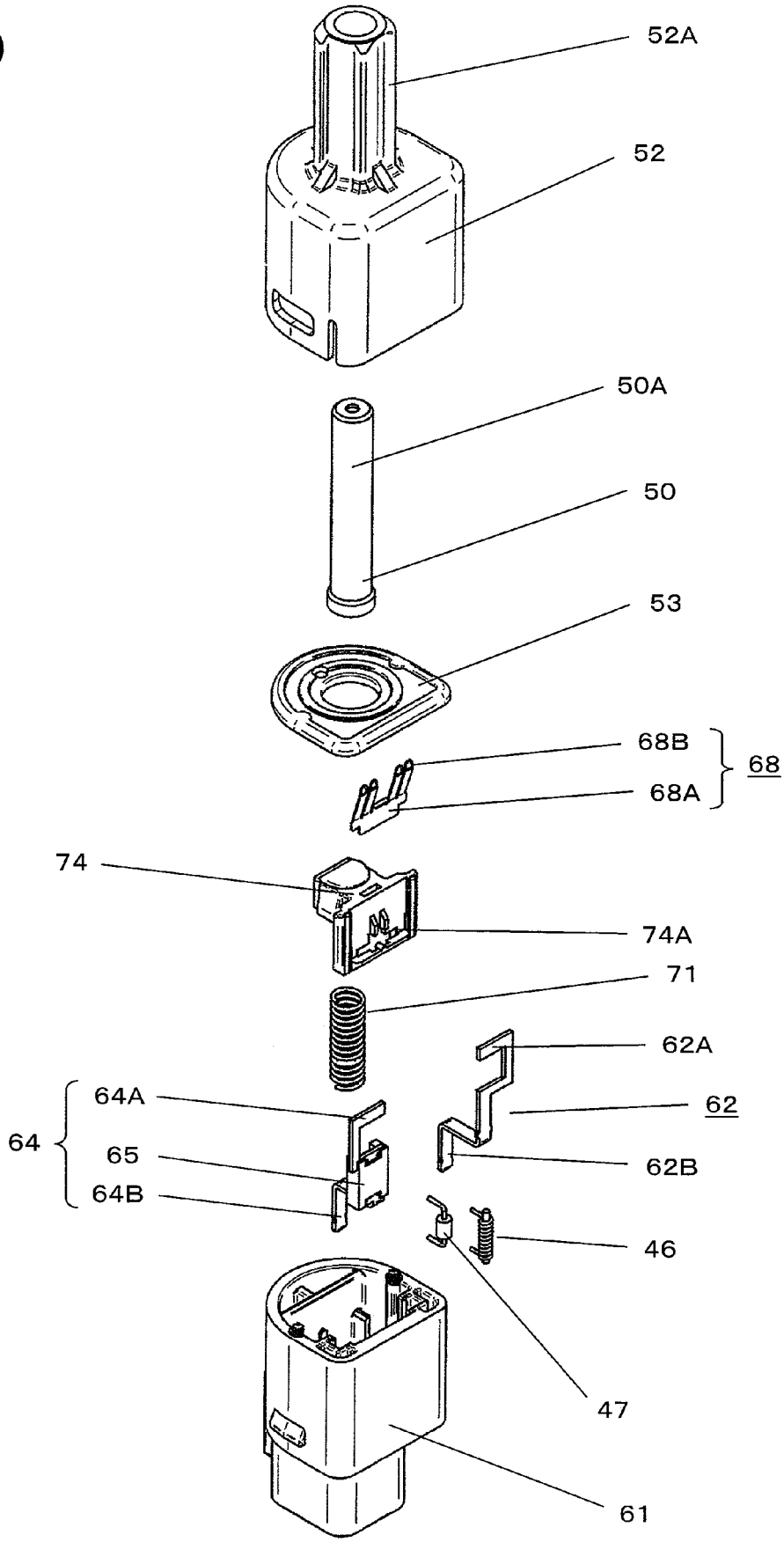
FIG. 10 is an exploded perspective view of the switch.
Figure 11:
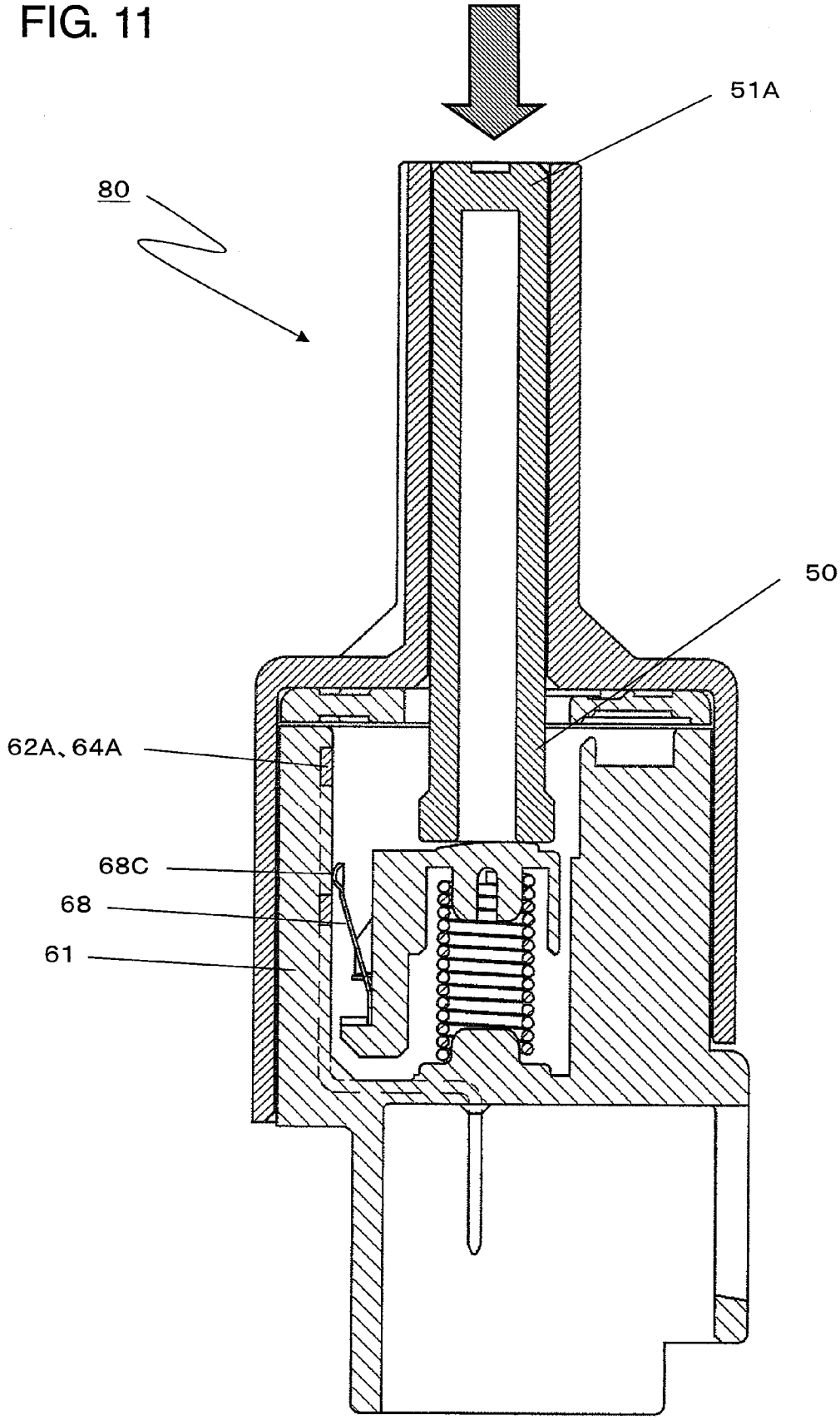
FIG. 11 is a side-section view of the switch in operation.
Figure 12:
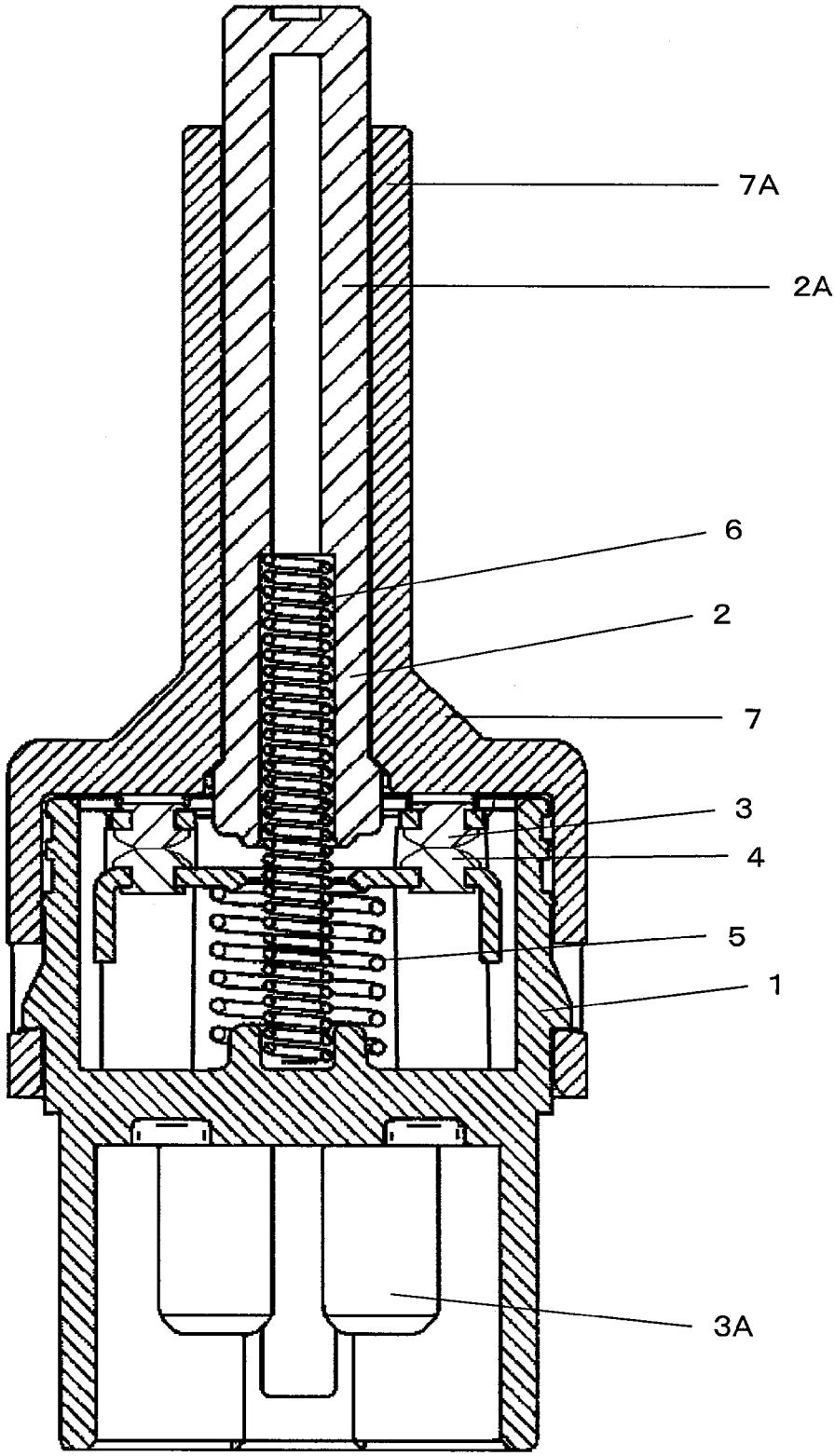
FIG. 12 is a section view of a conventional switch for a vehicle.

FIG. 9 is a side-section view of a switch for a vehicle in accordance with the third exemplary embodiment. FIG. 10 is an exploded perspective view of the switch. The switch of the embodiment, as shown in the drawings, is similar to that of the second exemplary embodiment in the following structure:

Case 61 is made of insulating resin and is formed into a top-open box shape. Driving unit 74 is disposed under actuating unit 50. Driving unit 74 and actuating unit 50 are accommodated in case 61 so as to be movable in the vertical direction. Returning spring 71 urges driving unit 74 and actuating unit 50 upward; Spacer 53 is disposed at the opening of case 61. Cover 52 covers the opening of case 61. Actuating unit 50 is inserted through hollow cylinder 52A of cover 52.

Fixed contact 62 has contact section 62A in the upper section and terminal section 62B in the lower section. Fixed contact 64 has contact section 64A and terminal section 64B, which are separately formed and secured by insulating resin-made holder 65 as an integrated structure. Contact section 64A and terminal section 64B are connected via coil 46, which is made of a conductive metal wire, and rectifying diode 47. Fixed contacts 62 and 64 are arranged in a side-by-side relationship in case 61.

As for the positioning of fixed contacts 62 and 64, each flat section of contact sections 62A and 64A are disposed in a side-by-side arrangement in the same plane with the inside surface of case 61.

Movable contact 68, which is made of a conductive metal plate with elasticity, has base 68A, a plurality of legs 68B and contacts 68C. Legs 68B extend upward, leaning forwardly, from both sides of base 68A. Ladle-like contacts 68C are disposed on each end of legs 68B. Base 68A is fixed by holder 74A disposed in front of driving unit 74.

When legs 68B of movable contact 68 in a slight compression make resilient contact with contact sections 62A and 64A of fixed contacts 62 and 64, respectively, fixed contacts 62 and 64 have electrical connection via movable contact 68. Switch 80 for a vehicle is thus structured.

The workings of switch 80 is similar to the switch described in the second exemplary embodiment.

Such structured switch 80 is disposed before the brake pedal. Under the condition where a driver does not step on the brake pedal, as shown in a side-sectional view of FIG. 11, operation shaft 50A in a depressed state moves actuating unit 50 downward. This allows contacts 68C of movable contacts 68 fixed in front of driving unit 74 to move away from contact sections 62A and 64A. Fixed contacts 62 and 64 have no electrical connection therebetween and therefore brake light 32 turns off.

When a driver steps on the brake pedal, as is shown in FIG. 9, operation shaft 50A is urged by spring-back force and is pushed upward. The movement also moves movable contact 68 upward. Sliding on the inside surface of case 61, contacts 68C make resilient contact with contact sections 62A and 64A of fixed contacts 62 and 64. In this way, electrical connection between fixed contacts 62 and 64 is established, so that the brake light turns on.

In the aforementioned switching operation between movable contact 68 and fixed contacts 62, 64, the structure having coil 46 and rectifying diode 47 prevents back-electromotive force and arc discharge between the contacts, enhancing stable contact operation and accordingly providing reliable electrical connection. The effect is the same as that obtained by the structure described in the second embodiment.

According to the structure of the embodiment, contacts 68C disposed at each tip of legs 68B of movable contact 68 slide over the inside surface of case 61 and move onto contact sections 62A, 64A to establish electrical connection with fixed contacts 62, 64. That is, switch 80 employs a sliding-contact mechanism. This allows switch 80 to have simply structured movable and fixed contacts, contributing to cost reduction of the switch.

According to the switch for a vehicle of the present invention, stable contact operation and therefore reliable electrical connection can be obtained by a simple structure. The switch is particularly suitable for on/off-control of the brake light of a car.

What is claimed is:

1. A switch for a vehicle comprising:

a case with a top-open box shape;

a plurality of fixed contacts disposed in the case;

an actuating unit disposed in the case so as to be movable in a vertical direction; and a movable contact that makes contact with the fixed contacts or goes away from the fixed contacts according to vertical movement of the actuating unit, wherein, a terminal section and a contact section of the fixed contacts are separately formed and the terminal section and the contact section are connected via a coil made of a conductive metal wire.

2. The switch of claim 1, wherein a rectifying diode is disposed in parallel with the coil between the terminal section and the contact section.

3. The switch of claim 2, wherein an insulating resin-made holder secures the terminal section and the contact section as an integrated structure.

4. The switch of claim 1, wherein an insulating resin-made holder secures the terminal section and the contact section as an integrated structure.

* * * * *

UNITED STATES PATENT AND TRADEMARK OFFICE

CERTIFICATE OF CORRECTION

PATENT NO. : 7,579,568 B2
APPLICATION NO. : 11/869982
DATED : August 25, 2009
INVENTOR(S) : Yoshiyuki Nakade It is certified that error appears in the above-identified patent and that said Letters Patent is hereby corrected as shown below:

Col. 10, lines 38-40
"a case with a top-open box shape;
a plurality of fixed contacts disposed in the case;
an actuating unit disposed in the case so as to be movable"

should read
-- a plurality of fixed contacts;
an actuating unit which is movable --

Signed and Sealed this

Twenty-sixth Day of January, 2010

David J. Kappos

David J. Kappos
*Director of the United States Patent and Trademark Office*